US008067899B2

(12) United States Patent
Longhino et al.

(10) Patent No.: US 8,067,899 B2
(45) Date of Patent: Nov. 29, 2011

(54) CIRCUIT ARRANGEMENT AND METHOD FOR OPERATING AT LEAST ONE FIRST AND A SECOND LAMP

(75) Inventors: Werner Longhino, Mehring (DE); Andreas Mitze, Traunreut (DE); Thomas Mudra, Kastl (DE); Markus Ziegler, San Pedro Garza Garcia (MX)

(73) Assignee: Osram AG, Munich (DE)

( * ) Notice: Subject to any disclaimer, the term of this patent is extended or adjusted under 35 U.S.C. 154(b) by 311 days.

(21) Appl. No.: 12/086,476

(22) PCT Filed: Dec. 5, 2006

(86) PCT No.: PCT/EP2006/069300

§ 371 (c)(1),
(2), (4) Date: Jul. 29, 2009

(87) PCT Pub. No.: WO2007/068622

PCT Pub. Date: Jun. 21, 2007

(65) Prior Publication Data

US 2010/0072918 A1 Mar. 25, 2010

(30) Foreign Application Priority Data

Dec. 16, 2005 (DE) ..... 10 2005 060 345

(51) Int. Cl.
*H05B 41/36* (2006.01)
*H05B 37/02* (2006.01)

(52) U.S. Cl. ..... 315/294; 315/244

(58) Field of Classification Search ..... 315/294, 315/291, 194, 244, 307, 94, 96
See application file for complete search history.

(56) References Cited

U.S. PATENT DOCUMENTS

| | | | | |
|---|---|---|---|---|
| 4,006,384 | A * | 2/1977 | Elms et al. | 315/323 |
| 5,331,253 | A * | 7/1994 | Counts | 315/209 R |
| 5,422,546 | A | 6/1995 | Nilssen | |
| 6,326,740 | B1 | 12/2001 | Chang et al. | |
| 7,675,242 | B2 * | 3/2010 | Longhino et al. | 315/276 |

FOREIGN PATENT DOCUMENTS

| | | |
|---|---|---|
| DE | 196 34 850 A1 | 3/1998 |
| DE | 699 16 251 T2 | 3/2005 |

* cited by examiner

*Primary Examiner* — Daniel D Chang

(57) ABSTRACT

A circuit arrangement for operating at least one first and second lamp each provided with a first and second coil electrode includes a first and second terminal for the first coil electrode of the first lamp, a first and second terminal for the second coil electrode of the first lamp, a first and second terminal for the first coil electrode of the second lamp, a first and second terminal for the second coil electrode of the second lamp, at least one supply connection for supplying voltage to the respective first coil electrode of the at least one first and second lamp, and at least one preheating device for the respective first coil electrode of the at least one first and second lamp. The second terminal of the first coil electrode of the first lamp is coupled to the second terminal of the first coil electrode of the second lamp while the preheating device encompasses a first preheating inductor and a second preheating inductor.

20 Claims, 8 Drawing Sheets

CIRCUIT ARRANGEMENT AND METHOD FOR OPERATING AT LEAST ONE FIRST AND A SECOND LAMP

TECHNICAL FIELD

The present invention relates to a circuit arrangement for operating at least one first and a second lamp, the first and the second lamp in each case having a first and a second coil electrode, comprising a first and a second terminal for the first coil electrode of the first lamp, a first and a second terminal for the second coil electrode of the first lamp, a first and a second terminal for the first coil electrode of the second lamp, a first and a second terminal for the second coil electrode of the second lamp, at least one supply terminal for supplying a supply voltage to the respective first coil electrode of the at least one first and second lamp and at least one preheating device for the respective first coil electrode of the at least one first and second lamp, the second terminal of the first coil electrode of the first lamp being coupled to the second terminal of the first coil electrode of the second lamp. The invention also relates to a corresponding operating method for at least one first and a second lamp which in each case have a first and a second coil electrode.

PRIOR ART

The problems dealt with by the present invention consist in the coil electrode detection in multi-lamp ballasts. This is intended to ensure that, when the input voltage is present, the ballast is only enabled when the last coil electrode in the base is contacted. Enabling before this time would entail the risk that the full starting voltage could be transferred to an operating person. Apart from complete coil electrode detection, however, the requirements of the coil electrodes for preheating and permanent heating must be met at the same time. From the prior art, no optimum solutions to these problems are known. The previous approaches include either a parallel circuit, see FIG. 1, or a series circuit, see FIG. 2, of the coil electrodes. The circuit arrangement shown in FIG. 1 has a first lamp Lp1 and a second lamp Lp2. The first lamp Lp1 has a first coil electrode W1 with a first terminal A1 and a second terminal A2 and a second coil electrode W2 with a first terminal A1 and a second terminal A2. The second lamp Lp2 has a first coil electrode W1 and a second coil electrode W2. The first coil electrode W1 comprises a first terminal A1 and a second terminal A2. The second coil electrode W2 comprises a first terminal A1 and a second terminal A2. A supply voltage Uv is applied via a resistor R1 to a point at which the terminal A1 of the coil electrode W1 of the first lamp Lp1 is coupled to terminal A1 of the coil electrode W1 of the second lamp Lp2. The junction of terminal A2 of the coil electrode W1 of the first lamp Lp1 with terminal A2 of the coil electrode W1 of the second lamp Lp2 is connected via the series circuit of a heating filament L1 and a diode D1, on the one hand, to the resistor R1, resulting in a parallel circuit of the two first coil electrodes W1. On the other hand, this point is coupled via a resistor R2 to an evaluating unit AW1. Although the first coil electrodes W1 are optimally heated via the parallel circuit of the two lamps Lp1 and Lp2 shown in FIG. 1, coil electrode detection is not possible because the evaluating unit AW1 receives a signal as soon as one of the two first coil electrodes W1 is used.

Although FIG. 2, which shows a series circuit of the lamps Lp1 and Lp2 and for which, as also for the subsequent figures, the reference symbols introduced in conjunction with FIG. 1 are adopted for identical and similar components, provides for coil electrode detection, investigations have shown that, due to the series connection of the respective first coil electrode W1 which, in practice, have different coil electrode resistances, these are colored black in the dimmer state after a short time.

DESCRIPTION OF THE INVENTION

The object of the present invention is, therefore, to develop the circuit arrangement initially mentioned, or the method initially mentioned, respectively, in such a manner that reliable coil electrode detection is made possible without the unwanted consequence of the coil electrodes being colored black in the dimmed state.

This object is achieved by a circuit arrangement having the features of patent claim 1 and, by an operating method having the features of patent claim 11.

The present invention is based on the finding that this object can be achieved by a clever combination of series and parallel circuit. The latter is made possible by providing two preheating devices, the junction of the two preheating devices additionally being connected to the respective second terminal of the first coil electrode of each lamp by means of a center tap. This measure guarantees, on the one hand, optimum preheating and permanent heating of the coil electrodes and, on the other hand, enables detection of each coil electrode.

In this context, the first terminal of the first coil electrode of the first lamp and the first terminal of the first coil electrode of the second lamp are preferably coupled to the supply terminal. In a preferred embodiment, the first preheating device is coupled to the first terminal of the first coil electrode of the first lamp and the second preheating device is coupled to the first terminal of the first coil electrode of the second lamp. In this arrangement, a first diode is coupled in the forward direction between the first preheating device and the first terminal of the first coil electrode of the first lamp and a second diode is coupled in the forward direction between the second preheating device and the first terminal of the first coil electrode of the second lamp. Furthermore, the coupling of the second terminal of the first coil electrode of the first lamp to the second terminal of the first coil electrode of the second lamp is preferably coupled to an evaluating device.

The principle on which the present invention is based can be expanded to circuit arrangements having more than two lamps. Such a circuit arrangement preferably has, for example, a first and a second terminal for the first coil electrode of a third lamp and a first and a second terminal for the second coil electrode of the third lamp, the first terminal for the first coil electrode of the third lamp being coupled to the supply terminal, the second terminal for the first coil electrode of the third lamp being coupled to an evaluating device, the first terminal for the second coil electrode of the third lamp being coupled to the first terminal of the second coil electrode of the first lamp and the second terminal for the second coil electrode of the third lamp being coupled to an evaluating device.

In a preferred exemplary embodiment comprising four lamps, the circuit arrangement has a first and a second terminal for a first coil electrode of a third lamp, a first and a second terminal for a second coil electrode of the third lamp, a first and a second terminal for a first coil electrode of a fourth lamp and a first and a second terminal for a second coil electrode of the fourth lamp. In this arrangement, the at least one supply terminal also is designed for supplying a supply voltage to the respective first coil electrode of the third and of the fourth lamp, the second terminal of the first coil electrode of the third lamp being coupled to a second terminal of the first coil electrode of the fourth lamp, the preheating device also comprising a third preheating inductance and a fourth preheating inductance which are arranged in series with one another, the coupling of the third and fourth preheating inductance being coupled to the coupling of the second terminal of the first coil electrode of the third lamp and of the second terminal of the first coil electrode of the fourth lamp.

In a preferred embodiment, the first and the second lamp can also be interconnected in such a manner that the coupling of the second terminal of the first coil electrode of the first lamp to the second terminal of the first coil electrode of the second lamp is coupled to the supply terminal. On the basis of this, preferred circuit arrangements are obtained which correspond to those in which the first terminal of the first coil electrode of the first lamp and the first terminal of the first coil electrode of the second lamp are coupled to the supply terminal, and correspond to the preferred embodiments mentioned in this connection, see above.

Thus, in a first preferred embodiment, the first preheating device is coupled to the first terminal of the first coil electrode of the first lamp and the second preheating device is coupled to the first terminal of the first coil electrode of the second lamp, a third diode being coupled in the forward direction between the first terminal of the first coil electrode of the first lamp and the first preheating device and a fourth diode being coupled in the forward direction between the first terminal of the first coil electrode of the second lamp and the second preheating device.

In the two last-mentioned variants, it is also preferred if the coupling of the first terminal of the first coil electrode of the first lamp to the first preheating device and the coupling of the first terminal of the first coil electrode of the second lamp are coupled to an evaluating device.

In the variant of the circuit arrangement according to the invention in which the coupling of the second terminal of the first coil electrode of the first lamp to the second terminal of the first coil electrode of the second lamp is coupled to the supply terminal, a preferred circuit arrangement comprising more than two lamps is obtained, for example, in that the circuit arrangement has a first and a second terminal for the first coil electrode of a third lamp and a first and a second terminal for the second coil electrode of the third lamp, the first terminal for the first coil electrode of the third lamp being coupled to an evaluating device, the second terminal for the first coil electrode of the third lamp being coupled to the supply terminal, the first terminal for the second coil electrode of the third lamp being coupled to the first terminal of the second coil electrode of the first lamp and the second terminal for the second coil electrode of the third lamp being coupled to the supply terminal.

Other advantageous embodiments can be obtained from the subclaims.

The preferred embodiments explained with reference to a circuit arrangement according to the invention correspondingly apply to the operating method according to the invention.

BRIEF DESCRIPTION OF THE DRAWINGS

In the text which follows, exemplary embodiments of the invention will now be explained in greater detail with reference to the attached drawings, in which.

PREFERRED EMBODIMENT OF THE INVENTION

Figure 1:
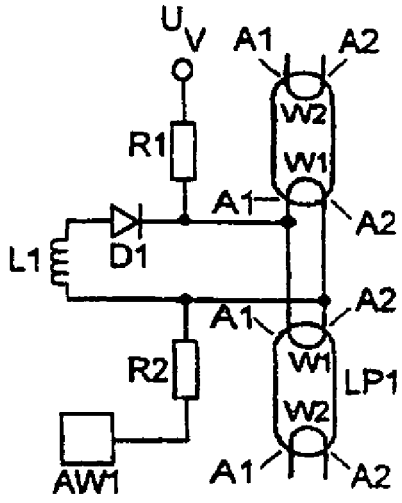
FIG 1 (Prior art)
FIG. 1 shows a circuit arrangement known from the prior art, in which the first coil electrode of the first lamp and the first coil electrode of the second lamp are connected in parallel.
Figure 2:
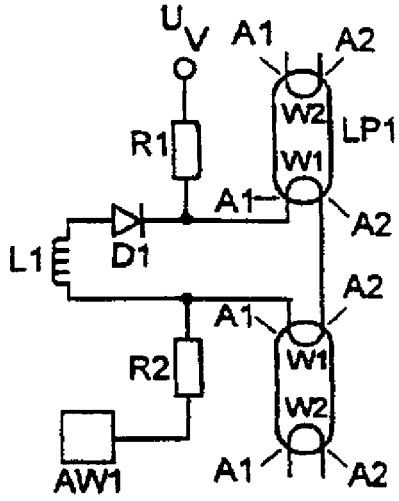
FIG 2 (Prior art)
FIG. 2 shows a circuit arrangement known from the prior art, in which the first coil electrode of the first lamp and the first coil electrode of the second lamp are connected in series.

As far as applicable, the reference symbols introduced with reference to the prior art represented in FIGS. 1 and 2 are retained for the embodiments, shown in FIGS. 3 to 8, of a circuit arrangement according to the invention and will not be explained again. To this extent, only the differences from the known circuit arrangements presented in FIGS. 1 and 2 will be discussed in the text which follows.

Figure 3:
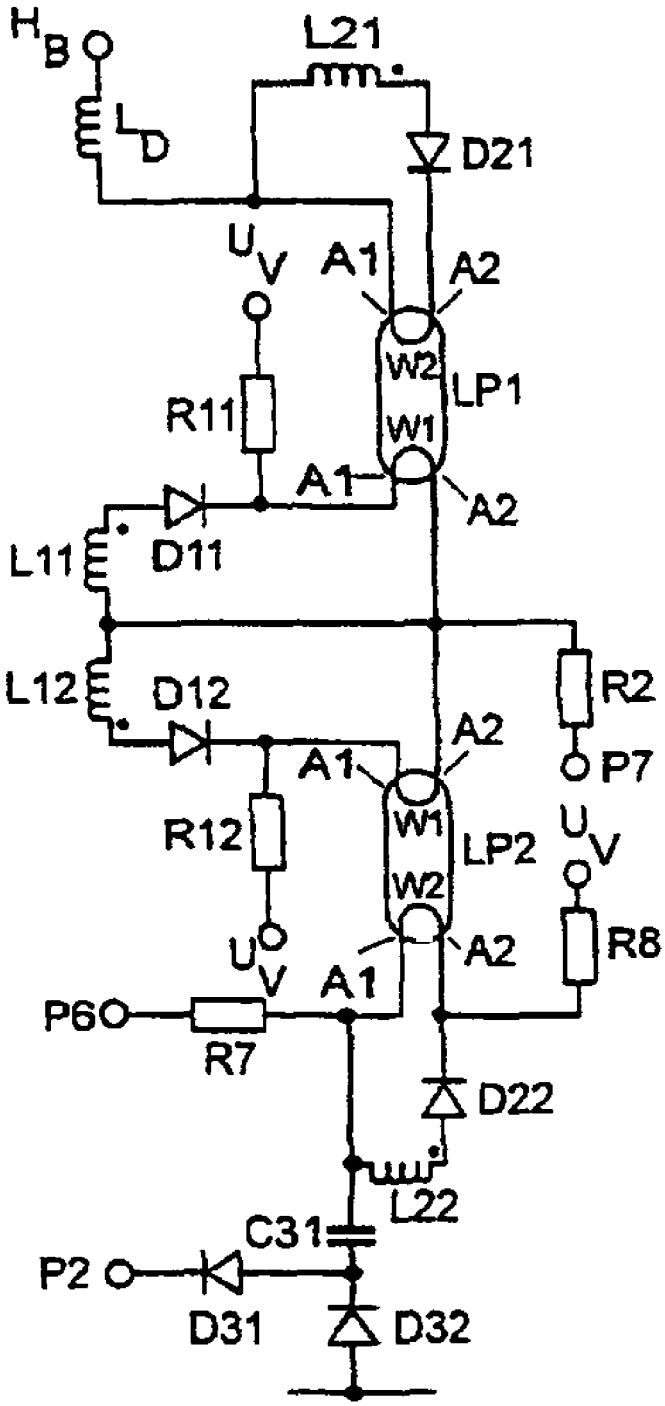
FIG. 3 shows a first embodiment of a circuit arrangement according to the invention comprising two lamps.

In the embodiment, shown in FIG. 3, of a circuit arrangement according to the invention, both the first terminal A1 of the first coil electrode W1 of the first lamp Lp1 and the first terminal A1 of the first coil electrode W1 of the second lamp Lp2 are connected via an ohmic resistance R11, R12 to the supply voltage Uv which—as is obvious to the expert in the field—preferably represents the so-called link voltage. The preheating device comprises a first preheating inductance L11 and a second preheating inductance L12. The preheating inductance L11 is connected via a diode D11 in the forward direction to the first terminal A1 of the first coil electrode W1 of the first lamp Lp1 whilst the second preheating inductance L12 is connected via a second diode D12 in the forward direction to the first terminal A1 of the first coil electrode W1 of the second lamp Lp2.

The junction between the second terminal A2 of the first coil electrode W1 of the first lamp Lp1 and the second terminal A2 of the second coil electrode W2 of the second lamp Lp2 is connected, on the one hand, to a terminal P7 of the evaluating unit AW1 via a resistor R2 and, on the other hand, in the manner of a center tap, to the junction between the first preheating inductance L11 and the second preheating inductance L12. The center tap is necessary so that, during the preheating or permanent heating, a parallel connection of the respective first coil electrode W1 can be ensured, by means of which black coloration of one of the coil electrodes due to different coil electrode resistances can be prevented. Due to the fact that both the first terminal A1 of the first coil electrode W1 of the first lamp Lp1 and the first terminal A1 of the first coil electrode W1 of the second lamp Lp2 are connected to the voltage supply Uv, reliable coil electrode detection is made possible at the evaluating unit AW1: if the evaluating unit AW1 is an analog unit, a summation of the proportion obtained across the lamp Lp1 and of the proportion obtained across the lamp Lp2 thus occurs. Preferably, evaluation occurs in analog form on the basis of different supply voltages Uv. An inductance L21 and a diode D21 are provided for preheating and/or permanent heating of the coil W2 of the lamp Lp1, the terminal A1 being connected via an inductance $L_D$ to the half-bridge center point. $H_B$ of a half-bridge circuit. As is obvious to the expert in the field, other circuit concepts for operating a circuit arrangement according to the invention can also be applied, for example full-bridge, reverse converter etc. The terminal. A2 of the coil W2 of lamp Lp2 is connected to the supply voltage Uv via a resistor R8. An inductance L22 and a diode D22 are provided for preheating. The signal at the output A1 is supplied to the terminal P6 of the evaluating unit AW1 via a resistor R7. The primary windings for the inductances L21, L22, L11 and L12 are not shown for reasons of clarity. Using the diodes D31, D32 and the capacitor C31, an actual-value detection of the lamp current of the lamp Lp2 is carried out at the input P2 of the evaluating unit AW1. As far as is appropriate for the evaluation by the evaluating unit, the supply voltage terminals identified uniformly by Uv can be connected to supply voltages Uv of different amplitude. The latter applies to all embodiments shown in FIGS. 4 to 8.

Figure 3A:
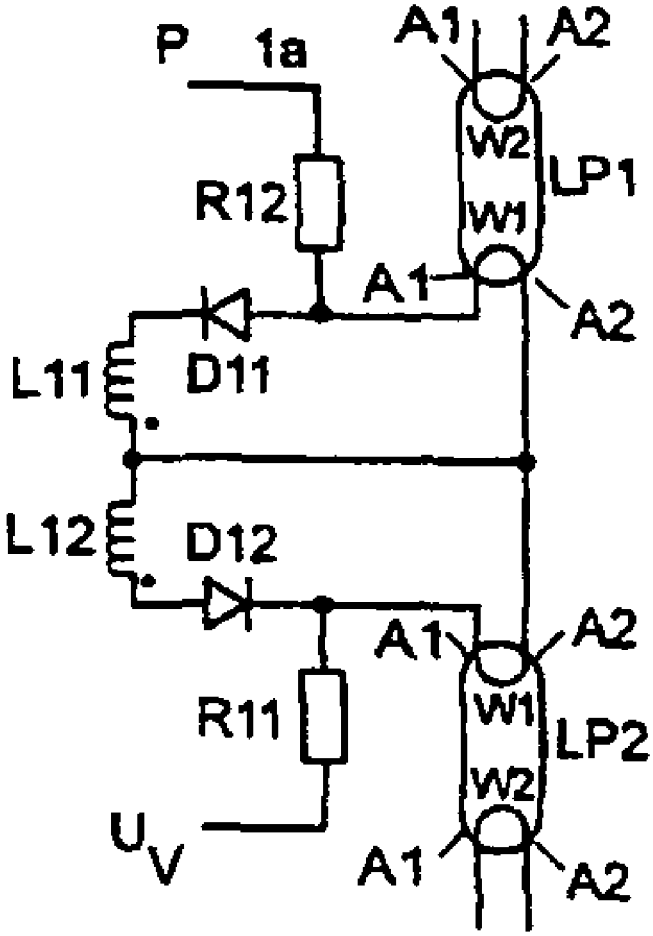
FIG. 3*a* shows a variant of the first embodiment of a circuit arrangement according to the invention comprising two lamps.

In FIG. 3*a*, an alternative variant of the embodiment according to FIG. 3 is shown in section. In comparison with FIG. 3, the polarity of the diode D11 is reversed in FIG. 3*a*. As a result, there is no direct-current path for a current which leads through the resistors R12 and R11 and only via one of the coils W1 of lamps Lp1 and Lp2. For this reason, only the resistor R11 is connected to the supply voltage Uv and not the resistor R12 in FIG. 3*a*, in comparison with FIG. 3. Instead, the resistor R12 is connected to the evaluating unit via terminal P3*a*. Advantageously compared with the variant from FIG. 3, the evaluating unit does not need to interrogate different amplitudes of the two coils W1 of lamps Lp1 and Lp2 at terminal P3*a*. Instead, a simple test whether there is a direct voltage or not is sufficient. This reduces not only the expenditure for coil interrogation but also increases the reliability of the interrogation. Furthermore, terminal P7 and the associated resistor R2 can be omitted in the variant according to FIG. 3*a*, compared with FIG. 3. This advantageously simplifies the topology of the circuit arrangement.

In comparison with FIG. 3, the direction of winding of the inductance L11 is also reversed in FIG. 3*a*; however, this does not have any effect on the coil detection as subject matter of the present invention. The direction of winding of the inductances is arbitrary for the coil detection.

Figure 4:
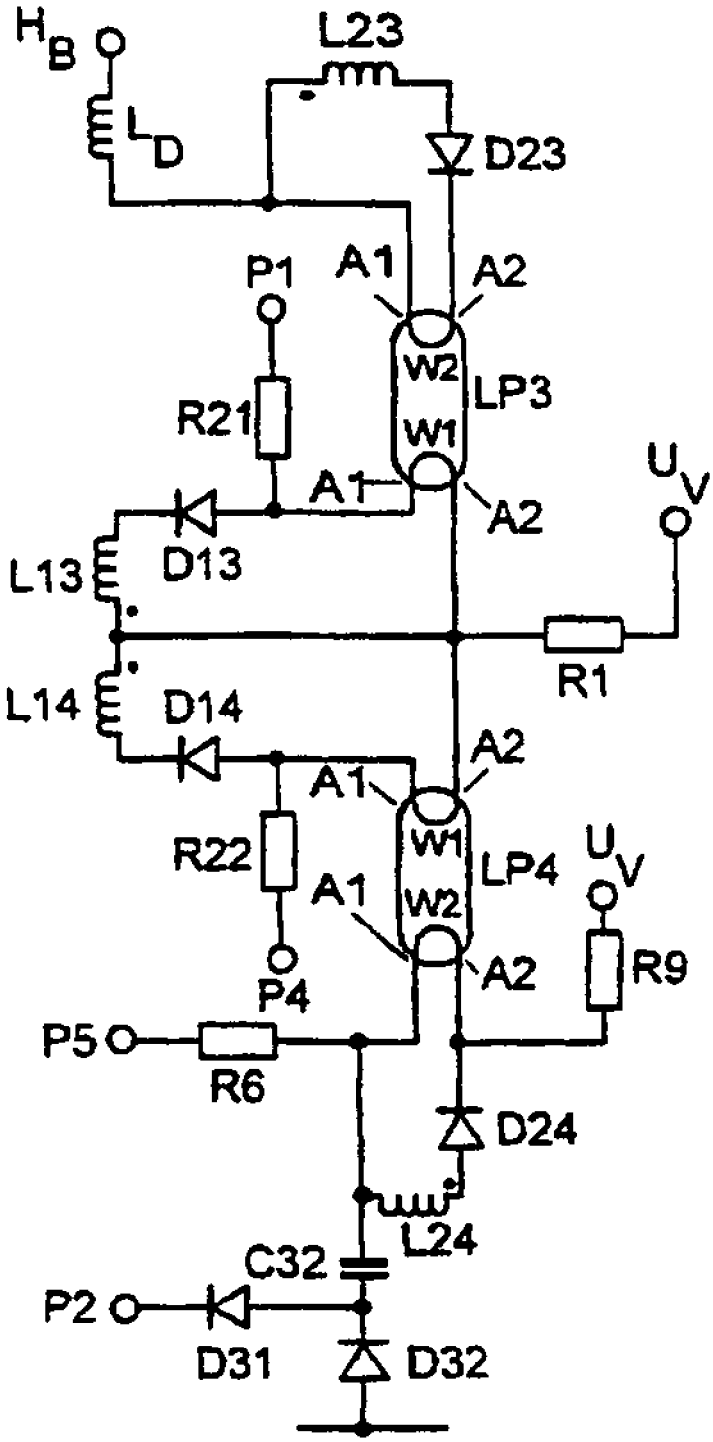
FIG. 4 shows a second embodiment of a circuit arrangement according to the invention comprising two lamps.
Figure 5:
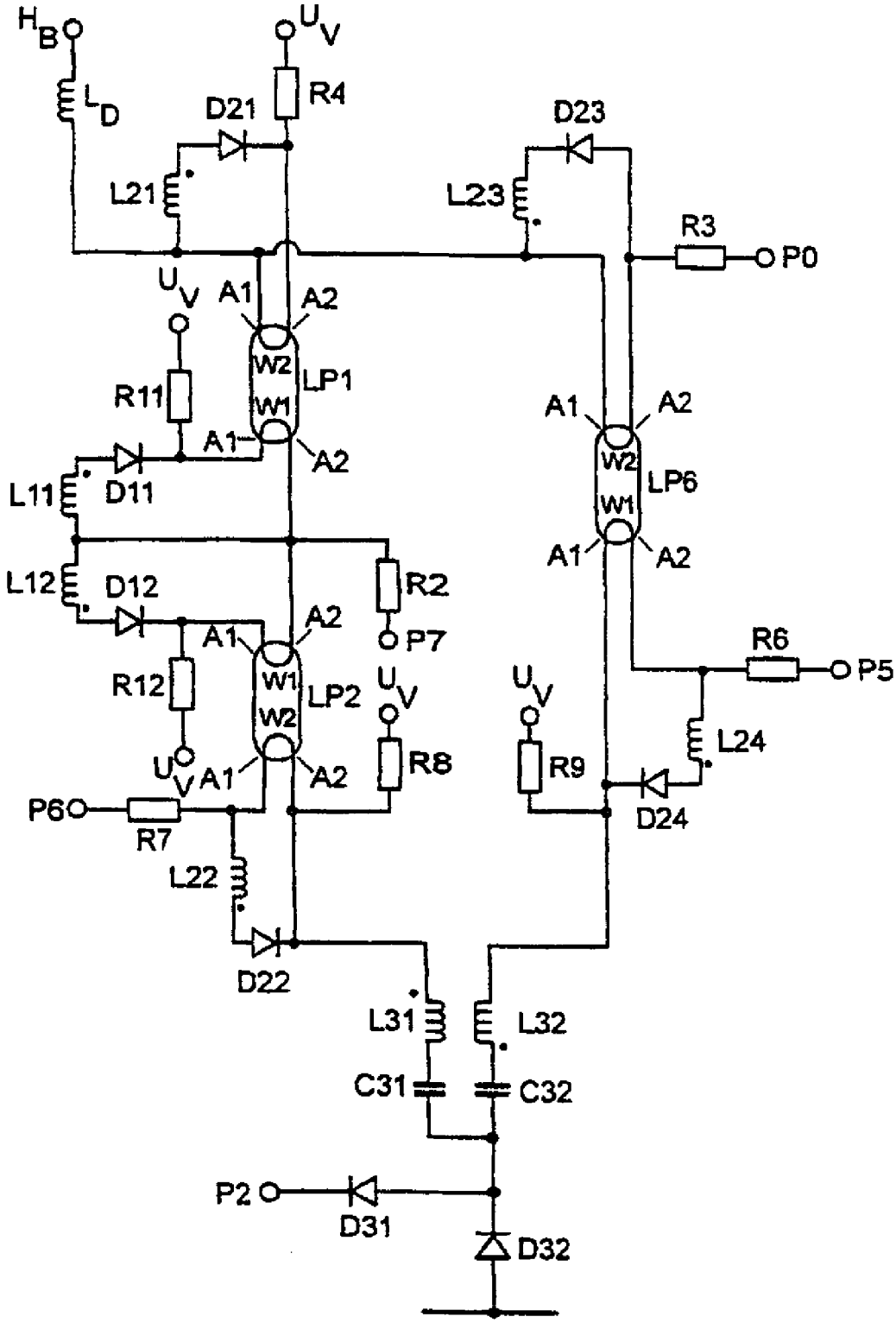
FIG. 5 shows a first embodiment of a circuit arrangement according to the invention comprising three lamps.

The advantageous change in the embodiment according to FIG. 3 with respect to FIG. 3*a* can also be similarly applied to the embodiments according to FIGS. 4 and 5.

In the second embodiment, shown in FIG. 4, of a circuit arrangement according to the invention, the junction between the second terminal A2 of the first coil electrode W1 of the first lamp Lp3 and the second terminal A2 of the first coil electrode W1 of the second lamp Lp4 is connected to the supply voltage Uv via a resistor R1. The first terminal A1 of the first coil electrode W1 of the first lamp Lp3 is connected via a resistor R21 to the input P1 of the evaluating unit AW1, the first terminal A1 of the first coil electrode W1 of the second lamp Lp4 is connected via a resistor R22 to the input P4 of the evaluating unit AW1. The first terminal A1 of the first coil electrode W1 of the first lamp Lp3 is connected via a diode D13 to a first preheating inductance L13 whilst the first terminal A1 of the first coil electrode W1 of the second lamp Lp4 is connected via a diode D14 to a second preheating inductance L14. The junction of the two preheating inductances L13 and L14 is connected via a center tap to the junction of the terminals A2 of the first coil W1 of the first lamp Lp3 and A2 of the first coil electrode W1 of the second lamp Lp4. The center tap again provides for connecting the two first coil electrodes W1 in parallel in preheating or permanent operation whilst providing for coil electrode detection via the signals supplied to the evaluating unit AW1 at its inputs. The diode D23 and the inductance L23 are used for preheating the second coil W2 of the first lamp Lp3 whilst the diode D24 and the inductance L24 are used for preheating the second coil electrode W2 of the second lamp Lp4. The operation of elements R6, P5, R9, C32, D31 and D32 corresponds to the operation of elements R7, P6, R8, C31, D32, D31 in the exemplary embodiment of FIG. 3.

In the embodiments shown in FIGS. 3 and 4, monitoring the coil W2 of lamp Lp1 and the coil W2 of lamp Lp3 can also be omitted. This is only necessary if, in multi-lamp operation, a balancing transformer (compare L31, L32 in FIG. 5) is used which delivers the starting voltage "from below".

FIG. 5 represents a development of the exemplary embodiment, presented in FIG. 3, in the form of a variant comprising three lamps Lp1, Lp2, Lp6. In this arrangement, terminal A2 of the second coil W2 of the lamp Lp1 is firstly connected to the supply terminal Uv via a resistor R4. The third lamp Lp6 has a first coil W1 with a first and a second terminal A1, A2 and a second coil W2 with a first and a second terminal A1, A2. Terminal A1 of the second coil W2 of the lamp Lp6 is connected to terminal A1 of the second coil W2 of lamp Lp1. Terminal A2 of the second coil W2 of lamp Lp6 is connected via a resistor R3 to terminal P0 of the evaluating unit. Terminal A2 of coil W1 of lamp Lp6 is connected via a resistor R6 to terminal P5 of the evaluating unit. Terminal A1 of coil W1 of lamp Lp6 is connected via a resistor R9 to the supply terminal Uv. An inductance L23 and a diode D23 connected in series therewith, and an inductance L24 and a diode D24, connected in series therewith, are again used for preheating and permanent heating of the associated coils. The circuit arrangement also has a balancing transformer which comprises inductances L31 and L32. The half-bridge coupling capacitors C31 and C32 are arranged in series with these two inductances L31, L32. The coupling capacitor C32 is connected to ground via a diode D32, the coupling capacitor C31 is connected to terminal P2 of the evaluating unit via a diode D31 for actual-value detection of the lamp current.

Figure 6:
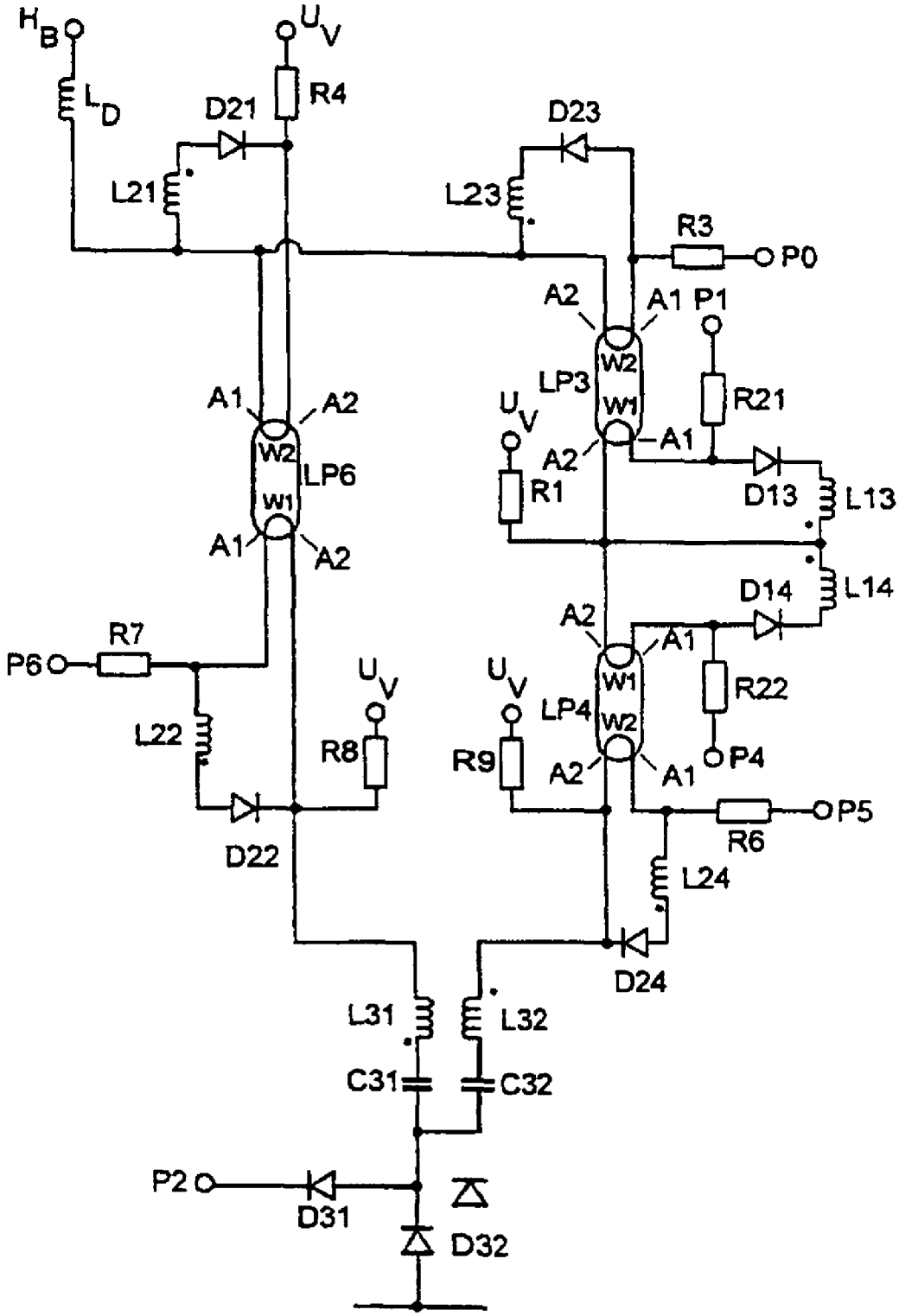
FIG. 6 shows a second embodiment of a circuit arrangement according to the invention comprising three lamps.

The embodiment shown in FIG. 6 is a development of the embodiment, shown in FIG. 4, to the use of three lamps Lp3, Lp4, Lp5, wherein the lamps Lp3, Lp4 of the circuit, however, are shown mirrored with respect to the arrangement in FIG. 4. To avoid duplicated terms, the terminal of the evaluating unit at which terminal A1 of the second coil W2 of lamp Lp4 is evaluated was designated by P5. Furthermore, terminal A1 of coil W2 of lamp Lp3 is supplied to input P0 of the evaluating unit via a resistor R4. Compared with the embodiment of FIG. 4, the embodiment shown in FIG. 6 has a further lamp Lp5. Terminal 1 of coil W1 of lamp Lp5 is conducted to input P6 of the evaluating unit via a resistor R7, terminal A2 of coil W1 of lamp Lp5 is connected to the supply voltage Uv via a resistor R8. Terminal A1 of coil W2 of lamp Lp5 is connected to terminal A2 of coil W2 of lamp Lp3. Terminal A2 of coil W2 of lamp Lp5 is connected to the supply voltage Uv via a resistor R4. Series circuits of in each case one inductance and one diode, i.e. the series circuit D21 L21 and the series circuit L22 D22 are again used for preheating and permanent heating of the associated coils of lamp Lp5. The operation of elements C31, C32, D31, D32, L31, L32 corresponds to that of FIG. 5.

Figure 7:
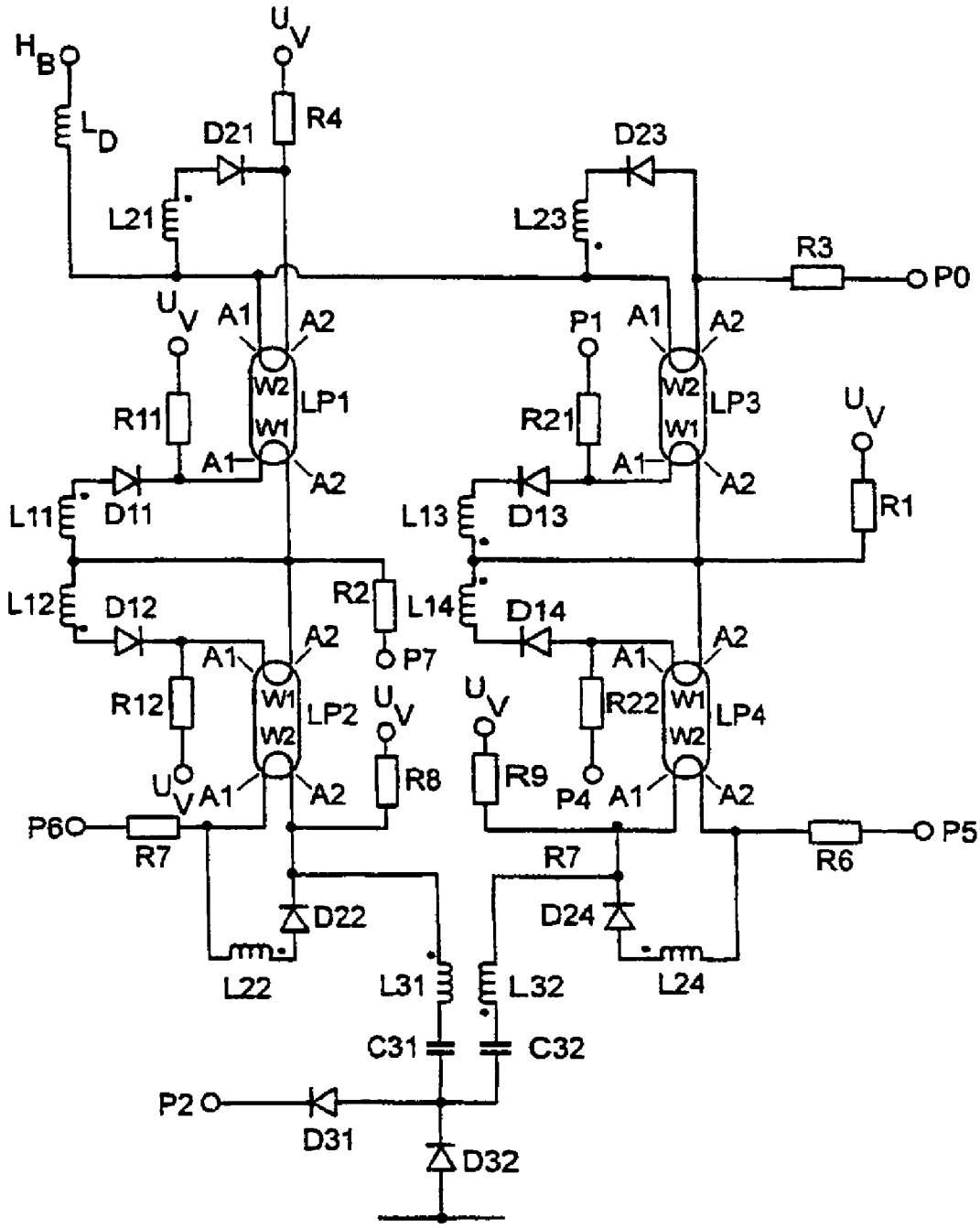
FIG. 7 shows an embodiment of a circuit arrangement according to the invention comprising four lamps.

The embodiment shown in FIG. 7 corresponds to a combination of the left-hand two lamps Lp1, Lp2 according to the embodiment of FIG. 5 and of the right-hand two lamps Lp3, Lp4 of the embodiment of FIG. 6. The situation that the circuitry at the two terminals A1, A2 of a coil W1 or W2 in the embodiment of FIG. 7 is exchanged compared with the embodiments of FIG. 5 or FIG. 6 is of no significance to the evaluation as is obvious to the expert in the field.

Two embodiments with four lamps, in which one comprises the embodiment shown in FIG. 3 twice and the other one comprises the embodiment shown in FIG. 4 twice, are not shown.

Figure 8:
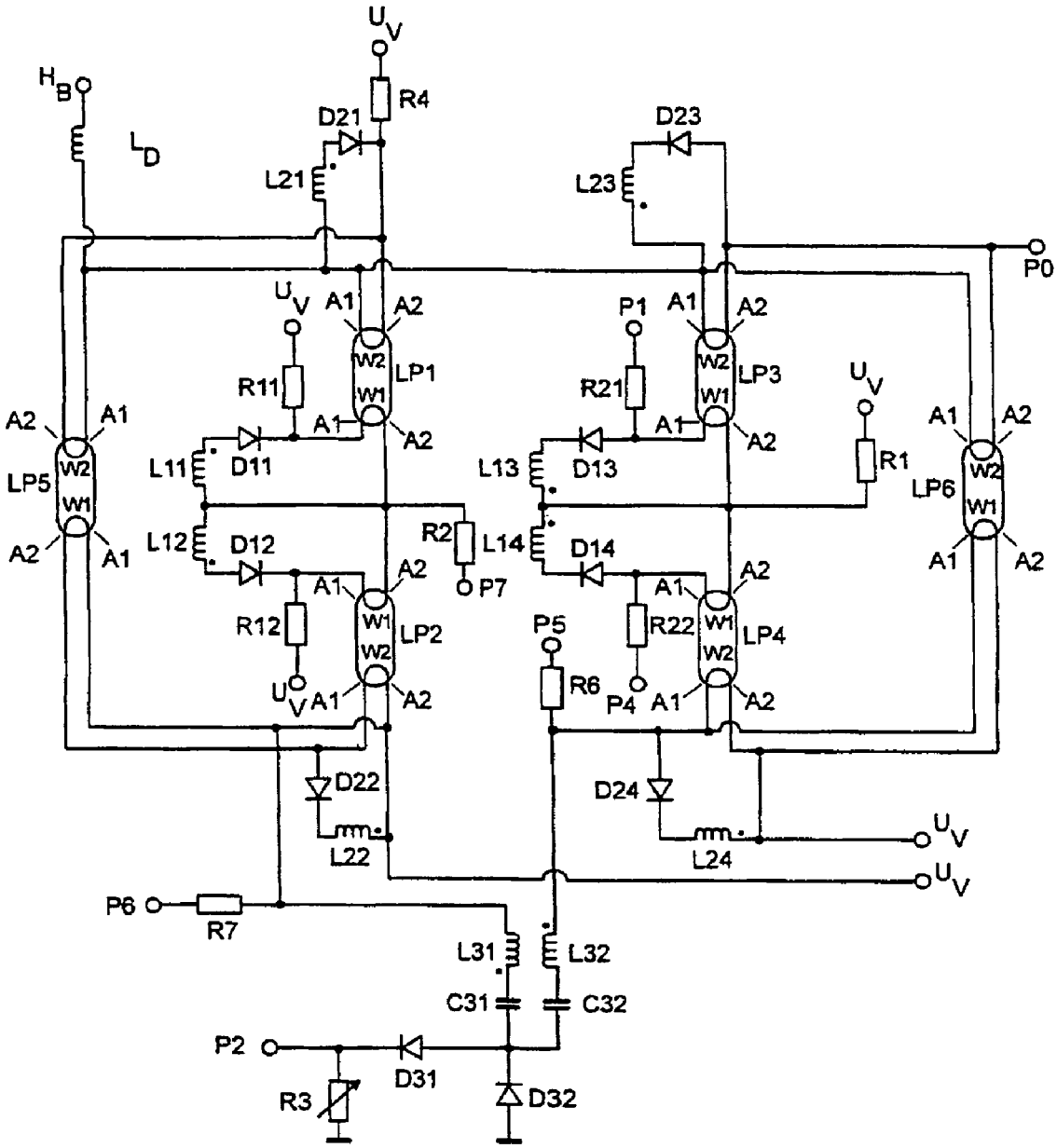
FIG. 8 shows an embodiment of a circuit arrangement according to the invention comprising six lamps.

FIG. 8 shows an embodiment with six lamps Lp1, Lp2, Lp3, Lp4, Lp5, Lp6, the embodiment according to FIG. 8 being composed of the embodiment from FIG. 5 from which lamps Lp1, Lp2 and Lp6 have been adopted, and of the embodiment of FIG. 6 from which lamps Lp3, Lp4 and Lp5 have been adopted. In a preferred development of the embodiment according to FIG. 8, the inductances L11, L12, L13 and L14 form the secondary windings of a first heating transformer whilst inductances L21, L22, L23 and L24 form the secondary windings for a second heating transformer.

In a preferred exemplary embodiment, inputs P0, P1 and P4, if present, are connected to digital inputs of a microprocessor of the evaluating unit AW1 whilst inputs P5, P6 and P7 are connected to analog inputs of a microprocessor of the evaluating unit AW1. If the coil electrode W2 of the lamp Lp1 and the coil electrode W2 of lamp Lp3 are used, a digital "1" is present at input P0, and otherwise a "0". This correspondingly applies to the coil electrodes W1 of lamp Lp4 and W1 of lamp Lp3 which are monitored at inputs P1 and P4. At input P7, it can be found whether coil electrodes W1 and W2 of lamp Lp1 are used. At input P5, it can be found whether coil electrodes W2 of the lamp Lp4 and W1 of lamp Lp6 are used. At input P6, it can be found whether the coil electrodes W2 of lamp Lp2 and W1, respectively, of lamp Lp5 are used. As already mentioned, input P2 is used for detecting the actual value of the lamp current for a control device, not shown.

The permanent heating of the coil electrodes, mentioned above, comes into consideration particularly during the dimming of the lamps in order to prevent the coil electrodes from becoming colored black.

The invention claimed is:

1. A circuit arrangement for operating at least one first and a second lamp, the first and the second lamp in each case having a first and a second coil electrode, comprising a first and a second terminal for the first coil electrode of the first lamp;

a first and a second terminal for the second coil electrode of the first lamp;

a first and a second terminal for the first coil electrode of the second lamp;

a first and a second terminal for the second coil electrode of the second lamp;

at least one supply terminal for supplying a supply voltage to the respective first coil electrode of the at least one first and/or second lamp;

at least one preheating device for the respective first coil electrode of the at least one first and second lamp;

the second terminal of the first coil electrode of the first lamp being coupled to the second terminal of the first coil electrode of the second lamp;

wherein the preheating device comprises a first preheating inductance and a second preheating inductance which are arranged in series with one another, the coupling of the first and of the second preheating inductance being coupled to the coupling of the second terminal of the first coil electrode of the first lamp and of the second terminal of the first coil electrode of the second lamp.

2. The circuit arrangement as claimed in claim 1, wherein the first terminal of the first coil electrode of the first lamp and the first terminal of the first coil electrode of the second lamp are coupled to the supply terminal.

3. The circuit arrangement as claimed in claim 2, wherein the first preheating device is coupled to the first terminal of the first coil electrode of the first lamp, and in that the second preheating device is coupled to the first terminal of the first coil electrode of the second lamp, a first diode being coupled in the forward direction between the first preheating device and the first terminal of the first coil electrode of the first lamp; and a second diode being coupled in the forward direction between the second preheating device and the first terminal of the first coil electrode of the second lamp.

4. The circuit arrangement as claimed in claim 3, wherein the coupling of the second terminal of the first coil electrode of the first lamp to the second terminal of the first coil electrode of the second lamp is coupled to an evaluating device.

5. The circuit arrangement as claimed in claim 3, wherein the circuit arrangement has a first and a second terminal for the first coil electrode of a third lamp and a first and a second terminal for the second coil electrode of the third lamp, the first terminal for the first coil electrode of the third lamp being coupled to the supply terminal;

the second terminal for the first coil electrode of the third lamp being coupled to an evaluating device;

the first terminal for the second coil electrode of the third lamp being coupled to the first terminal of the second coil electrode of the first lamp; and the second terminal for the second coil electrode of the third lamp being coupled to an evaluating device.

6. The circuit arrangement as claimed in claim 2, wherein the coupling of the second terminal of the first coil electrode of the first lamp to the second terminal of the first coil electrode of the second lamp is coupled to an evaluating device.

7. The circuit arrangement as claimed in claim 2, wherein the circuit arrangement has a first and a second terminal for the first coil electrode of a third lamp and a first and a second terminal for the second coil electrode of the third lamp, the first terminal for the first coil electrode of the third lamp being coupled to the supply terminal;

the second terminal for the first coil electrode of the third lamp being coupled to an evaluating device;

the first terminal for the second coil electrode of the third lamp being coupled to the first terminal of the second coil electrode of the first lamp; and the second terminal for the second coil electrode of the third lamp being coupled to an evaluating device.

8. The circuit arrangement as claimed in claim 2, wherein it also has:

a first and a second terminal for a first coil electrode of a third lamp;

a first and a second terminal for a second coil electrode of the third lamp;

a first and a second terminal for a first coil electrode of a fourth lamp; and a first and a second terminal for a second coil electrode of the fourth lamp;

the at least one supply terminal also being designed for supplying a supply voltage to the respective first coil electrode of the third and of the fourth lamp;

the second terminal of the first coil electrode of the third lamp being coupled to the second terminal of the first coil electrode of the fourth lamp;

the preheating device also comprising a third preheating inductance and a fourth preheating inductance which are arranged in series with one another, the coupling of the third and of the fourth preheating inductance being coupled to the coupling of the second terminal of the first coil electrode of the third lamp and of the second terminal of the first coil electrode of the fourth lamp.

9. The circuit arrangement as claimed in claim 1, wherein the first terminal of the first coil electrode of the second lamp is coupled to the supply terminal.

10. The circuit arrangement as claimed in claim 9, wherein the first preheating device is coupled to the first terminal of the first coil electrode of the first lamp, and in that the second preheating device is coupled to the first terminal of the first coil electrode of the second lamp, a first diode being coupled in the reverse direction between the first preheating device and the first terminal of the first coil electrode of the first lamp; and a second diode being coupled in the forward direction between the second preheating device and the first terminal of the first coil electrode of the second lamp.

11. The circuit arrangement as claimed in claim 10, wherein the first terminal of the first coil electrode of the first lamp is coupled to an evaluating device.

12. The circuit arrangement as claimed in claim 9, wherein the first terminal of the first coil electrode of the first lamp is coupled to an evaluating device.

13. The circuit arrangement as claimed in claim 1, wherein the coupling of the second terminal of the first coil electrode of the first lamp to the second terminal of the first coil electrode of the second lamp is coupled to the supply terminal.

14. The circuit arrangement as claimed in claim 13, wherein the first preheating device is coupled to the first terminal of the first coil electrode of the first lamp, and in that the second preheating device is coupled to the first terminal of the first coil electrode of the second lamp, a third diode being coupled in the forward direction between the first terminal of the first coil electrode of the first lamp and the first preheating device; and a fourth diode being coupled in the forward direction between the first terminal of the first coil electrode of the second lamp and the second preheating device.

15. The circuit arrangement as claimed in claim 14, wherein the coupling of the first terminal of the first coil electrode of the first lamp to the first preheating device and the coupling of the first terminal of the first coil electrode of the second lamp are coupled to an evaluating device.

16. The circuit arrangement as claimed in claim 14, wherein the circuit arrangement has a first and a second terminal for the first coil electrode of a third lamp and a first and a second terminal for the second coil electrode of the third lamp, the first terminal for the first coil electrode of the third lamp being coupled to an evaluating device;

the second terminal for the first coil electrode of the third lamp being coupled to the supply terminal;

the first terminal for the second coil electrode of the third lamp being coupled to the first terminal of the second coil electrode of the first lamp; and the second terminal for the second coil electrode of the third lamp being coupled to the supply terminal.

17. The circuit arrangement as claimed in claim 13, wherein the coupling of the first terminal of the first coil electrode of the first lamp to the first preheating device and the coupling of the first terminal of the first coil electrode of the second lamp are coupled to an evaluating device.

18. The circuit arrangement as claimed in claim 17, wherein the circuit arrangement has a first and a second terminal for the first coil electrode of a third lamp and a first and a second terminal for the second coil electrode of the third lamp, the first terminal for the first coil electrode of the third lamp being coupled to an evaluating device;

the second terminal for the first coil electrode of the third lamp being coupled to the supply terminal;

the first terminal for the second coil electrode of the third lamp being coupled to the first terminal of the second coil electrode of the first lamp; and the second terminal for the second coil electrode of the third lamp being coupled to the supply terminal.

19. The circuit arrangement as claimed in claim 13, wherein the circuit arrangement has a first and a second terminal for the first coil electrode of a third lamp and a first and a second terminal for the second coil electrode of the third lamp, the first terminal for the first coil electrode of the third lamp being coupled to an evaluating device;

the second terminal for the first coil electrode of the third lamp being coupled to the supply terminal;

the first terminal for the second coil electrode of the third lamp being coupled to the first terminal of the second coil electrode of the first lamp; and the second terminal for the second coil electrode of the third lamp being coupled to the supply terminal.

20. A method for operating at least one first lamp and a second lamp, the at least one first lamp and a second lamp each having a first and a second coil electrode, the method comprising:

supplying, with at least one supply terminal, a supply voltage to the respective first coil electrode of the at least one first lamp and second lamp;

heating, with at least one preheating device, the respective first coil electrode of the at least one first and second lamp;

utilizing a circuit arrangement comprising:

a first and a second terminal for the first coil electrode of the first lamp;

a first and a second terminal for the second coil electrode of the first lamp;

a first and a second terminal for the first coil electrode of the second lamp; and a first and a second terminal for the second coil electrode of the second lamp;

wherein the second terminal of the first coil electrode of the first lamp being coupled to the second terminal of the first coil electrode of the second lamp; and wherein the preheating device comprises a first preheating inductance and a second preheating inductance which are arranged in series with one another, the coupling of the first and of the second preheating inductance being coupled to the coupling of the second terminal of the first coil electrode of the first lamp and of the second terminal of the first coil electrode of the second lamp.

* * * * *